US006256919B1

(12) United States Patent
Brazeau

(10) Patent No.: US 6,256,919 B1
(45) Date of Patent: Jul. 10, 2001

(54) FIREARM MAGAZINE LOCK

(76) Inventor: David Brazeau, 120 Avenida Melisenda, San Dimas, CA (US) 91773,
.

( * ) Notice: Subject to any disclaimer, the term of this patent is extended or adjusted under 35 U.S.C. 154(b) by 0 days.

(21) Appl. No.: 09/235,055

(22) Filed: Jan. 20, 1999

(51) Int. Cl.[7] ..... F41A 17/36

(52) U.S. Cl. ..... 42/70.11; 42/70.4; 42/70.5; 42/70.6

(58) Field of Search ..... 42/1.02, 49.01, 42/49.02, 70.02, 70.04, 70.05, 70.06, 70.11

(56) References Cited

U.S. PATENT DOCUMENTS

| | | | | |
|---|---|---|---|---|
| 4,384,420 | * | 5/1983 | Von Muller | 42/1 |
| 4,457,091 | * | 7/1984 | Wallerstein | 42/1 LP |
| 4,532,729 | * | 8/1985 | Von Muller | 42/1 |
| 4,584,855 | * | 4/1986 | Burlingame | 70/38 A |
| 4,587,756 | * | 5/1986 | Jakubaschk et al. | 42/50 |
| 4,619,062 | * | 10/1986 | Johnson | 42/70.11 |
| 4,672,763 | * | 6/1987 | Cunningham | 42/70.11 |
| 4,833,811 | * | 5/1989 | Wilkinson | 42/70.08 |
| 5,361,525 | * | 11/1994 | Bowes | 42/70.11 |
| 5,467,550 | * | 11/1995 | Mumbleau | 42/70.11 |
| 5,782,029 | * | 7/1998 | Brooks | 42/70.11 |
| 5,974,717 | * | 11/1999 | Brooks | 42/70.11 |
| 5,992,076 | * | 11/1999 | Magnusson | 42/70.11 |
| 6,052,934 | * | 4/2000 | Carpenter | 42/70.11 |

* cited by examiner

*Primary Examiner*—Michael J. Carone
*Assistant Examiner*—John Richardson
(74) *Attorney, Agent, or Firm*—Robert D. Fish; Fish & Associates, LLP

(57) ABSTRACT

A magazine lock for a firearm, the firearm having a grip, a magazine well, and a hammer, the magazine lock has a body sized and dimensioned to be removeably positioned within the magazine well of the firearm and a locking body retaining mechanism at least intermittently inhibiting removal of the body from the magazine well. The body, when positioned within the magazine well of the firearm, prevents at least one of the following: cocking the hammer of the firearm; removal of the firearm from a tether; removal of a key located inside the magazine well; and accessing any retaining member of the locking body retaining mechanism by disassembling the firearm grip. Unauthorized removal of the firearm can be accomplished by coupling the firearm to a less moveable object via a tether coupled to the firearm via the magazine lock. The firearm can be transported with a key for unlocking the magazine lock locked within the magazine well for later removal through the use of a second key.

12 Claims, 9 Drawing Sheets

FIREARM MAGAZINE LOCK

FIELD OF INVENTION

The field of the invention is firearms, particularly firearm locking and retaining methods and devices.

BACKGROUND

It is often desirable when dealing with firearms to have methods and devices available for preventing theft or accidental or unauthorized discharge of the firearms. Although many such methods and devices are known, most are in some way unsuitable or problematic.

One desirable feature of a safety device which is aimed at preventing unauthorized use of a firearm is the ability to lock the safety device in place. Many devices are unsuitable for preventing unauthorized use simply because they cannot be locked in place, and thus can be bypassed by simply removing the device. Examples of such devices include the device described in U.S. Pat. No. 4,619,062 issued to Johnson, and the device described in U.S. Pat. No. 5,388,362 issued to Melcher.

Some firearm safety devices provide an unsatisfactory solution in that their use requires modification of the firearm, such as by modifying existing parts or adding additional parts to the firearm. For example, the magazine safety device described in U.S. Pat. No. 5,388,362 issued to Melcher requires modifying the pistol itself to include an additional spring and plate. Similarly, the device described in U.S. Pat. No. 4,384,420 issued to Von Muller requires modification of the firearm by drilling a hole into the slide or bolt carrier of the firearm.

A firearm safety device also may be unsuitable because it can be easily overcome by simply disassembling a portion of the device or firearm. For example, the magazine safety described in U.S. Pat. No. 5,388,362 issued to Melcher can be bypassed by simply disassembling the firearm and removing the safety device.

Some firearm safety devices, such as U.S. Pat. No. 5,782,029 issued to Brooks, rely on the device being positioned and subsequently "locked" to prevent use of the firearm. Although it may be desirable in some instances to have a safety device that can be positioned in the firearm, but still allow use of the firearm, in other instances such a feature is undesirable as it increases the likelihood that the firearm will be judged to be inoperative when in fact it is not. Moreover, such devices tend to rely on moveable parts to prevent the firearm from being discharged. Such a reliance on moveable parts is at times also undesirable due to the tendency of such parts to wear out and/or fail.

Another feature which may be undesirable in a firearm safety device is the need to insert a portion of the device into the barrel of the firearm, as with the device of U.S. Pat. No. 5,271,174 issued to Bentley, and the device of U.S. Pat. No. 5,016,377 issued to Gunning. Insertion of anything into the barrel of a firearm may be undesirable because of the potential for damage to the barrel.

Yet another feature which may be undesirable in a firearm safety device is that use of the device requires storing and or transporting the firearm in a condition in which it would normally not be stored or transported. As an example, the device of U.S. Pat. No. 5,016,377 issued to Gunning intentionally requires that the action be left open while the device is in use. Similarly, one embodiment of the device of U.S. Pat. No. 5,532,729 issued to Von Muller requires that the slide be partially pulled back to allow it to be blocked.

Thus there is a continuing need to develop new firearm locking devices and methods.

SUMMARY OF INVENTION

In a firearm having a grip, a magazine well, and a hammer, a magazine lock has a body sized and dimensioned to be removeably positioned within the magazine well of the firearm, and a locking body retaining mechanism at least intermittently inhibiting removal of the body from the magazine well. When positioned within the magazine well of the firearm, the body prevents at least one of the following: cocking the hammer of the firearm; removal of the firearm from a tether; removal of a key located inside the magazine well; and accessing any retaining member of the locking body retaining mechanism by disassembling the firearm grip.

When used with a tether, the magazine lock can function as part of a firearm retaining system. Such a system can advantageously be used for discouraging removal of a firearm by coupling the firearm to an object which is more difficult to transport than the firearm itself such as a counter or post. A method incorporating such a system would advantageously comprise the steps of; providing a firearm; providing a tether; providing a magazine lock; coupling the tether to an object which is more difficult to transport than the firearm; coupling the tether to the magazine lock; coupling the firearm to the tether by inserting the magazine lock into the magazine well of the firearm; locking the magazine lock into the well to prevent the firearm from being uncoupled from the tether.

The magazine lock can also be used in a method for transporting a firearm along with a key for the magazine lock while still inhibiting unauthorized use of the firearm before it reaches its destination. By using the magazine lock to lock the key within the magazine well of the firearm, the firearm can be transported in a relatively secure fashion until the magazine lock and key are removed by a custodian having a second key for operating the magazine lock. Such a method for transporting a firearm would comprise the steps of: inserting a first key within the magazine well of the firearm; inserting the magazine lock into the magazine well of the firearm; transporting the combination of firearm, key, and magazine lock; utilizing a second key to unlock the magazine lock to allow it and the first key to be removed from the magazine well of the firearm.

DETAILED DESCRIPTION

Figure 2:
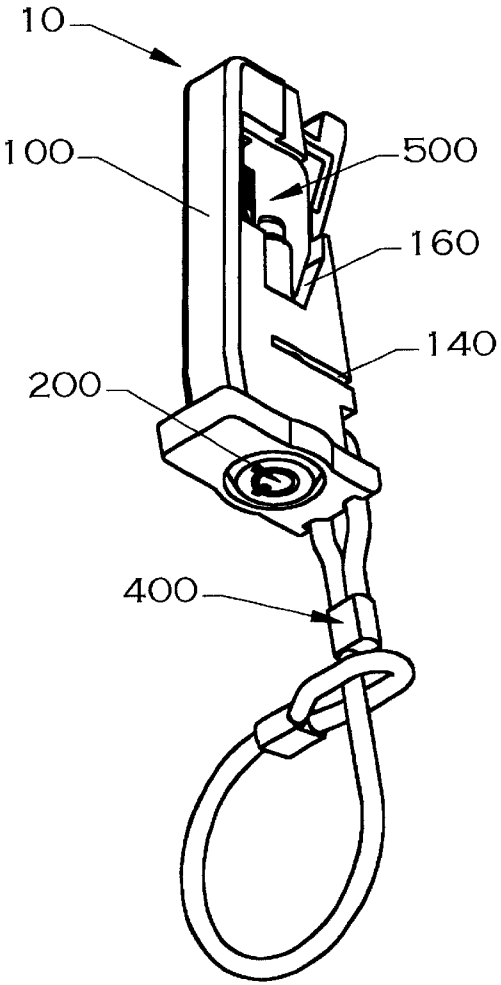
FIG. 2 is a second perspective view of the apparatus of FIG. 1.
Figure 1:
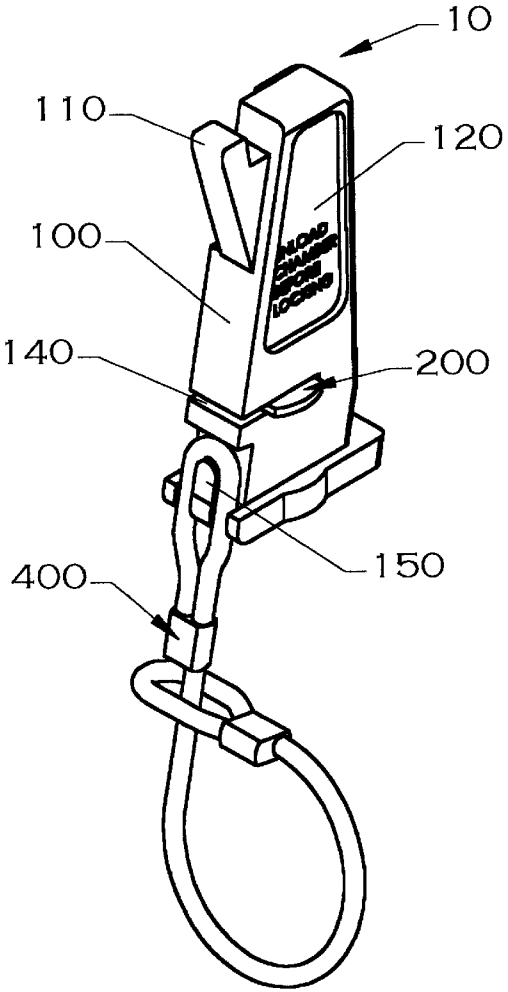
FIG. 1 is a perspective view of an apparatus according to the present invention.
Figure 4:
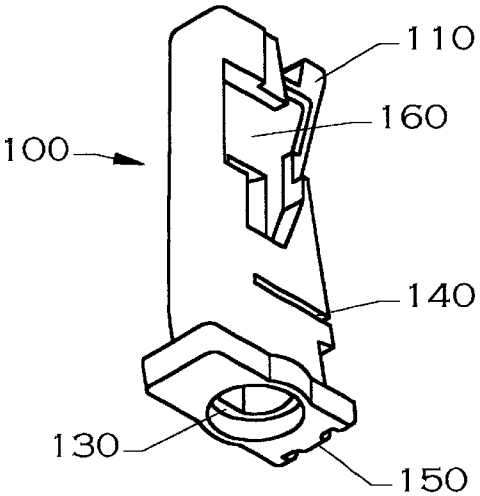
FIG. 4 is a perspective view of body 100 of FIG. 1.

Referring to FIGS. 1 and 2, a firearm magazine lock 10 has a body 100, a locking body retaining mechanism 200, and tether 400. Body 100 comprises safety block post 110, safety warning cavity 120, body retaining mechanism cavity 130 and slot 140, tether post 150, and key storage cavity 160. The locking body retaining mechanism 200 comprises locking mechanism 210 positioned at least partially within retaining mechanism cavity 130, and retaining member 220 positioned at least partially within slot 140. Magazine lock 10 is intended to be used with a firearm such as firearm 300 shown in FIGS. 5–11.

Figure 9:
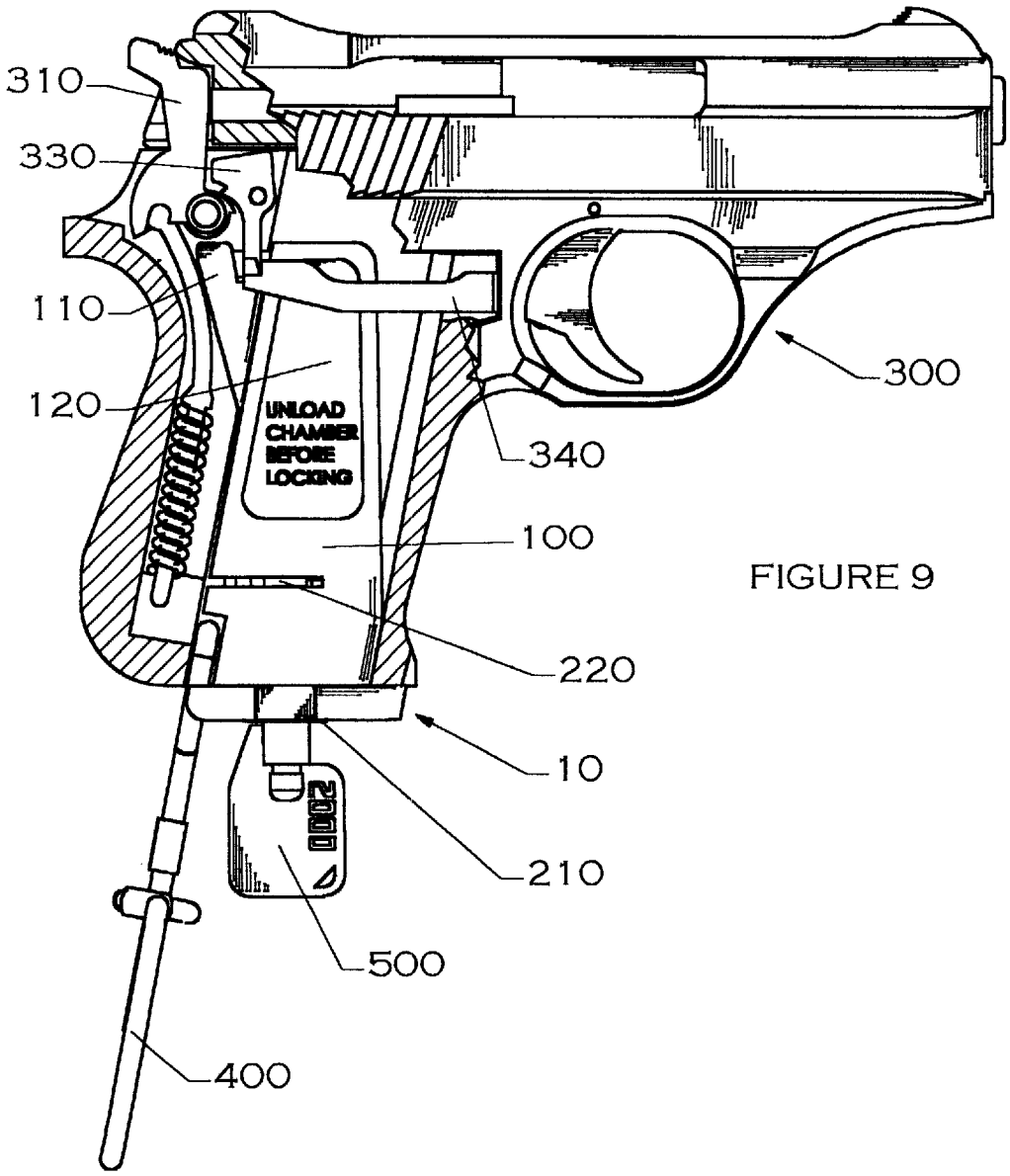
FIG. 9 is a fifth view in a series of views showing the apparatus of FIG. 1 being positioned within the firearm.
Figure 10:
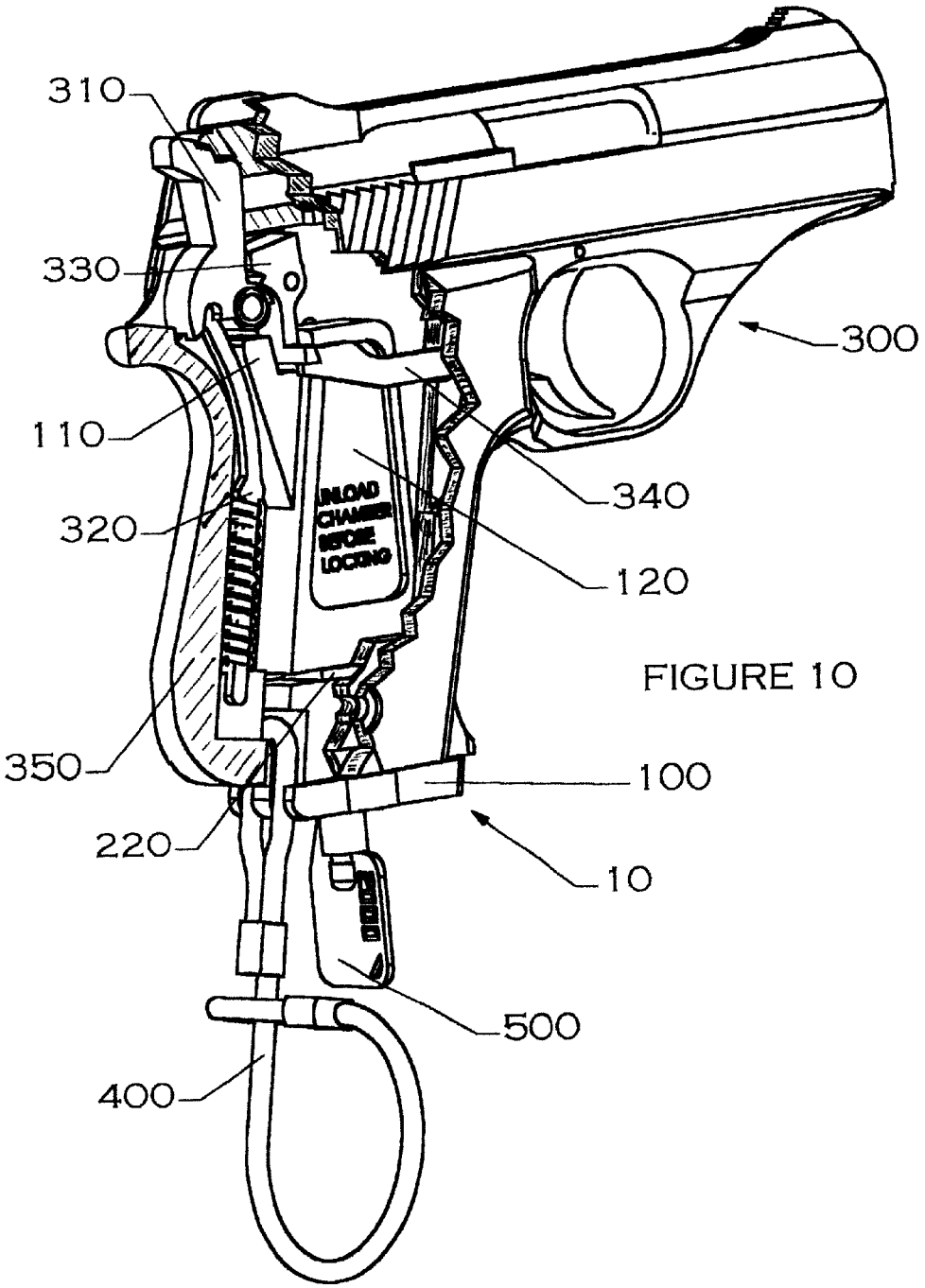
FIG. 10 is a cutaway view of the apparatus of FIG. 1 in combination with a firearm.
Figure 11:
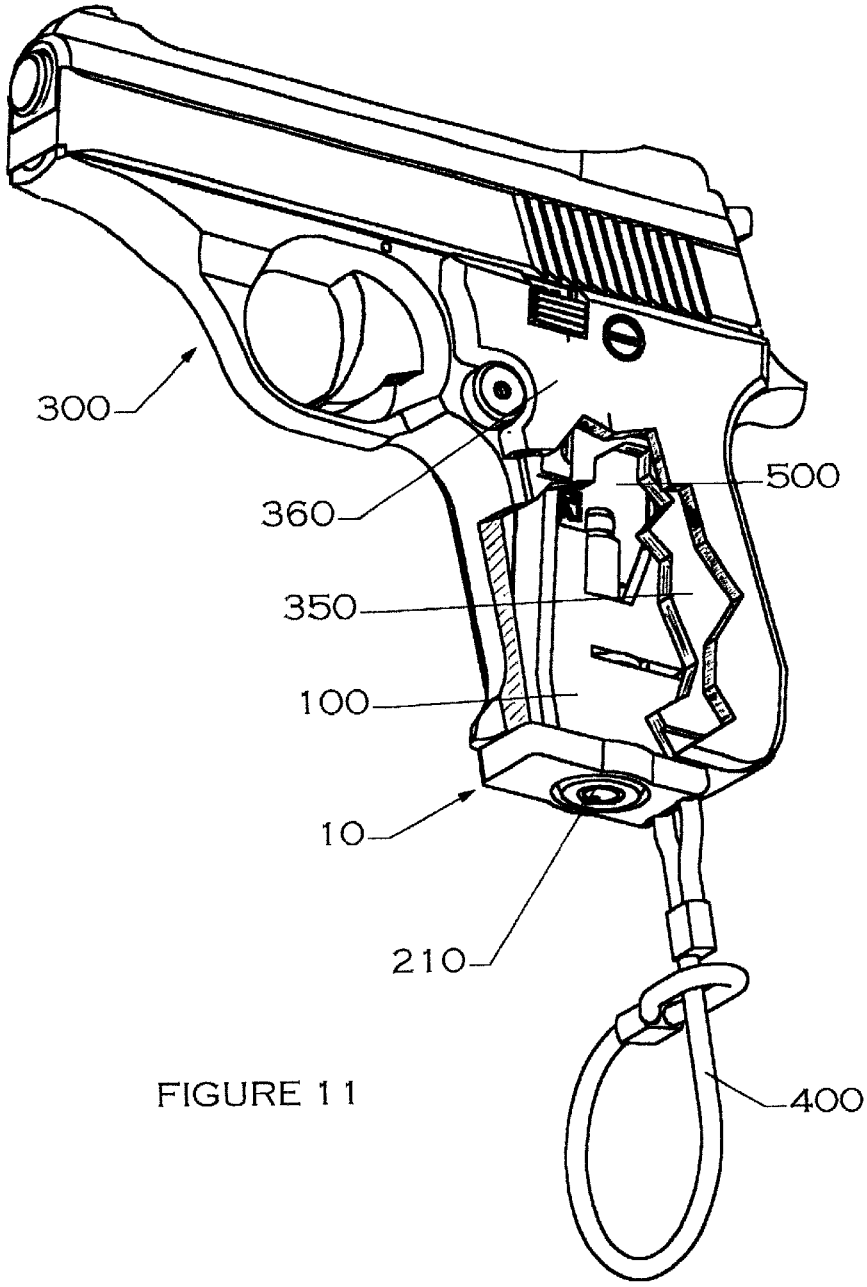
FIG. 11 is a second cutaway view of the apparatus of FIG. 1 in combination with a firearm.

Referring to FIGS. 5–9, magazine lock 10 can be inserted into the magazine well 360 of firearm 300 while firearm 300 is uncocked. Once fully inserted into the magazine well of firearm 300, as shown in FIGS. 9–11, magazine lock 10 prevents firearm 300 from being cocked and also prevents insertion of a magazine into the magazine well of firearm 300. When used with tether 400, magazine lock 10 and tether 400 can be used to couple firearm 300 to another object to prevent removal of firearm 300.

Body 100 is preferably a single piece of die cast zinc. Alternative embodiments may have a body formed using alternative methods or materials, but it is thought that forming body 100 from a single piece will aid in the manufacture of magazine lock 10, decrease the likelihood of failure of magazine lock 10, and decrease the likelihood that magazine lock 10 will be bypassed or rendered inoperative.

Body 100 is preferably sized and dimensioned such that it slides into a pistol magazine well only when the hammer of the pistol is not cocked, and prevents the hammer from being cocked while the body is fully inserted into the magazine well. Referring to FIG. 10, safety block post 110 blocks movement of the hammer of firearm 300 while device 10 is fully inserted within the magazine well of the firearm. Cocking of the hammer 310 can be prevented by blocking one or more of the sear 330, hammer 310, and strut 320. The inclusion and use of safety block post 110, eliminates the need to move any pistol components, other than the original ammunition feeding device, to insert the locking mechanism. It is contemplated that alternative embodiments may block trigger movement in addition to or in place of blocking movement of the hammer. Safety block post 110 need not be included in all embodiments of the claimed magazine lock. It should be noted that inclusion of block post 1 10 on body 100 allows the magazine lock 10 to function as a safety device whenever it is fully inserted into the magazine well of a firearm, regardless of whether or not it is locked into the well. Moreover, the magazine lock 10 does not rely on any moving parts which might be subject to wear or failure to prevent firearm 300 from being fired.

Body 100 preferably includes safety warning cavity 120. The inclusion of safety warning cavity 120 allows instructions and or warnings regarding the use of device 10 or any of its components to be placed on the device in a location which is at least somewhat protected during insertion and removal of the device. Warning cavity 120 may be sized and dimensioned in any number of ways so long as it is visible to one using magazine lock 10 and provides some protection to any materials placed within warning cavity 120. Warning cavity 120 need not be included in all embodiments of the claimed magazine lock.

Figure 3:
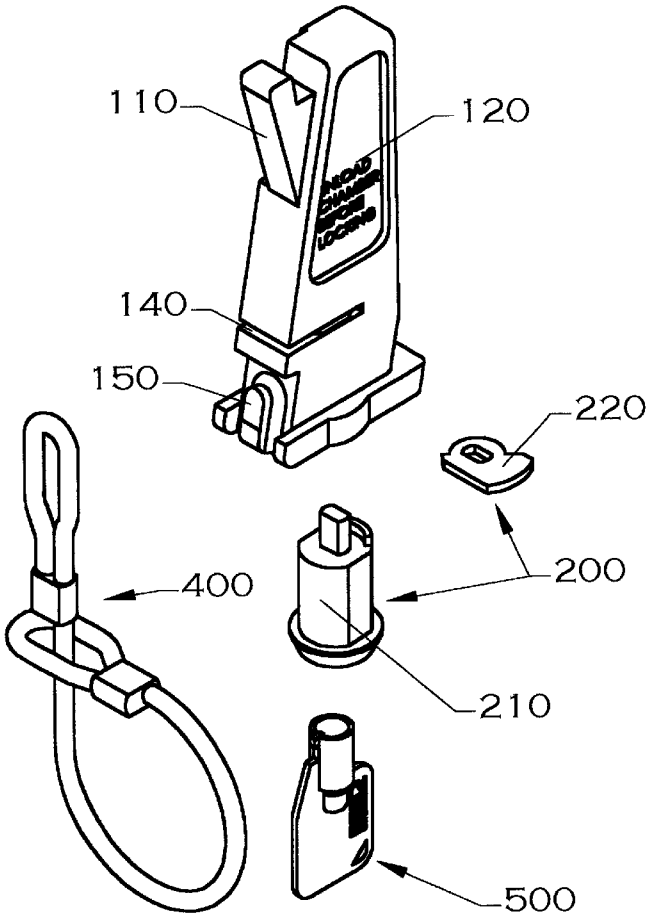
FIG. 3 is an exploded perspective view of the apparatus of FIG. 1.
Figure 5:
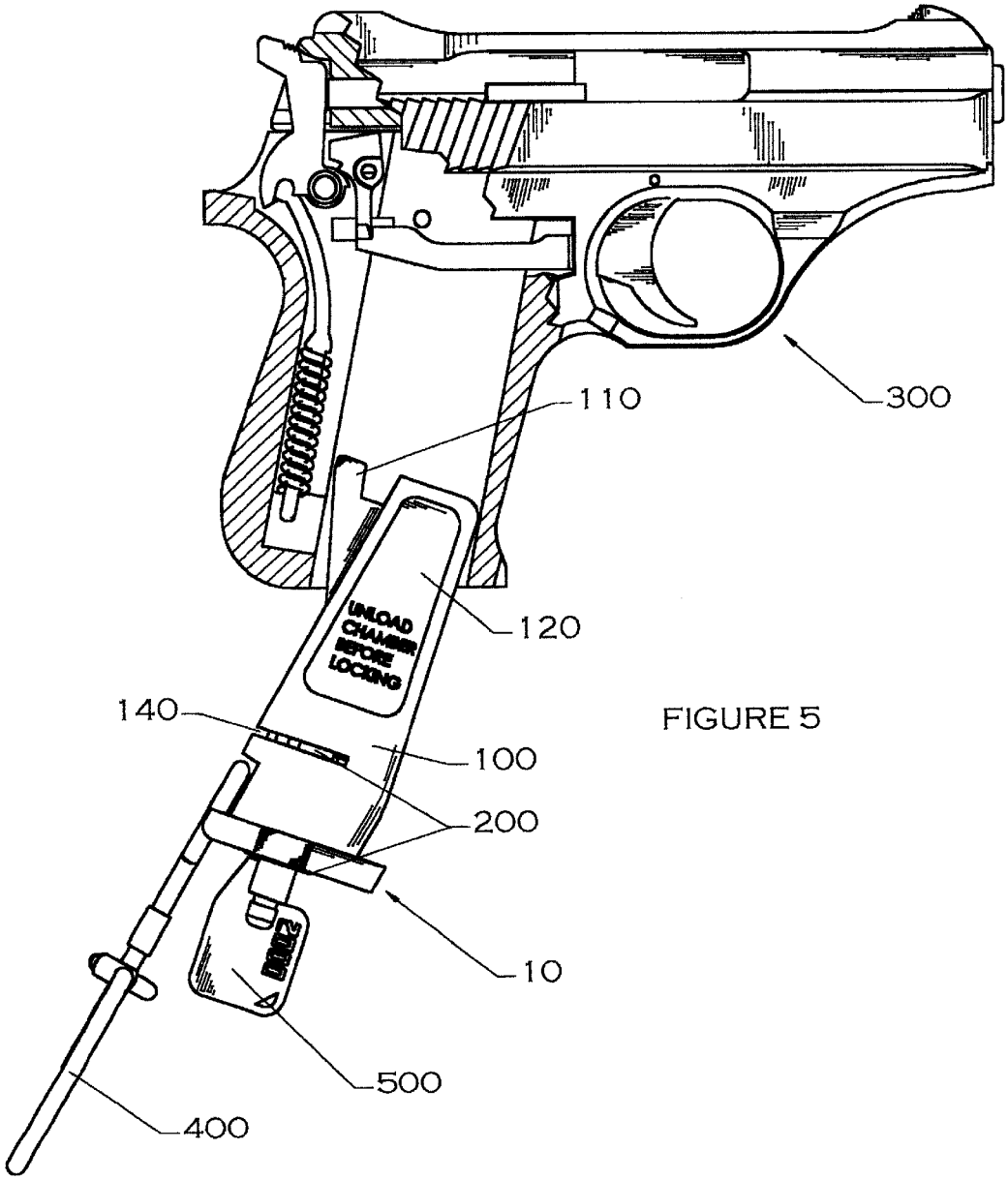
FIG. 5 is the first view in a series of views showing the apparatus of FIG. 1 being positioned within the firearm.
Figure 6:
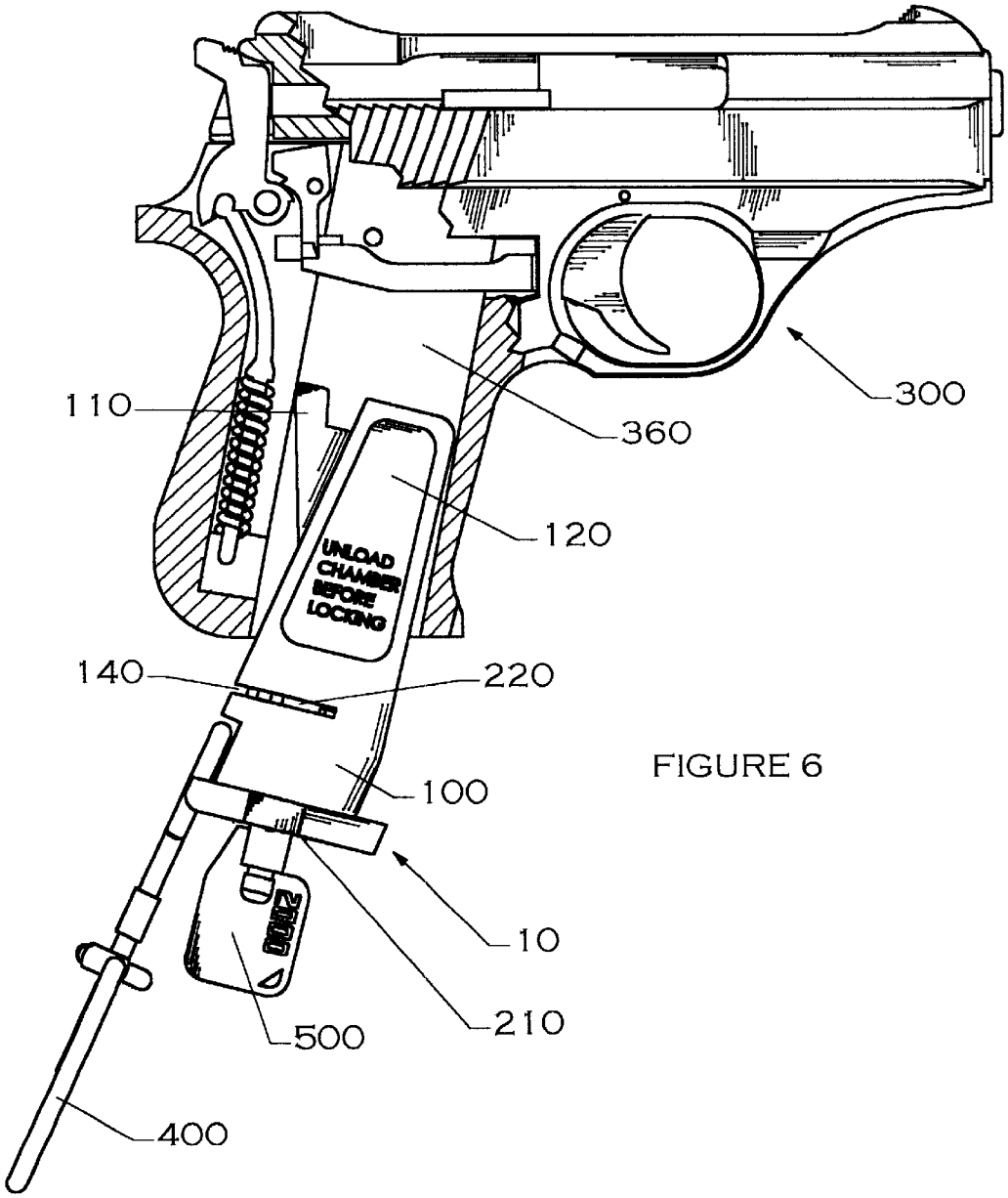
FIG. 6 is the second view in a series of views showing the apparatus of FIG. 1 being positioned within the firearm.
Figure 7:
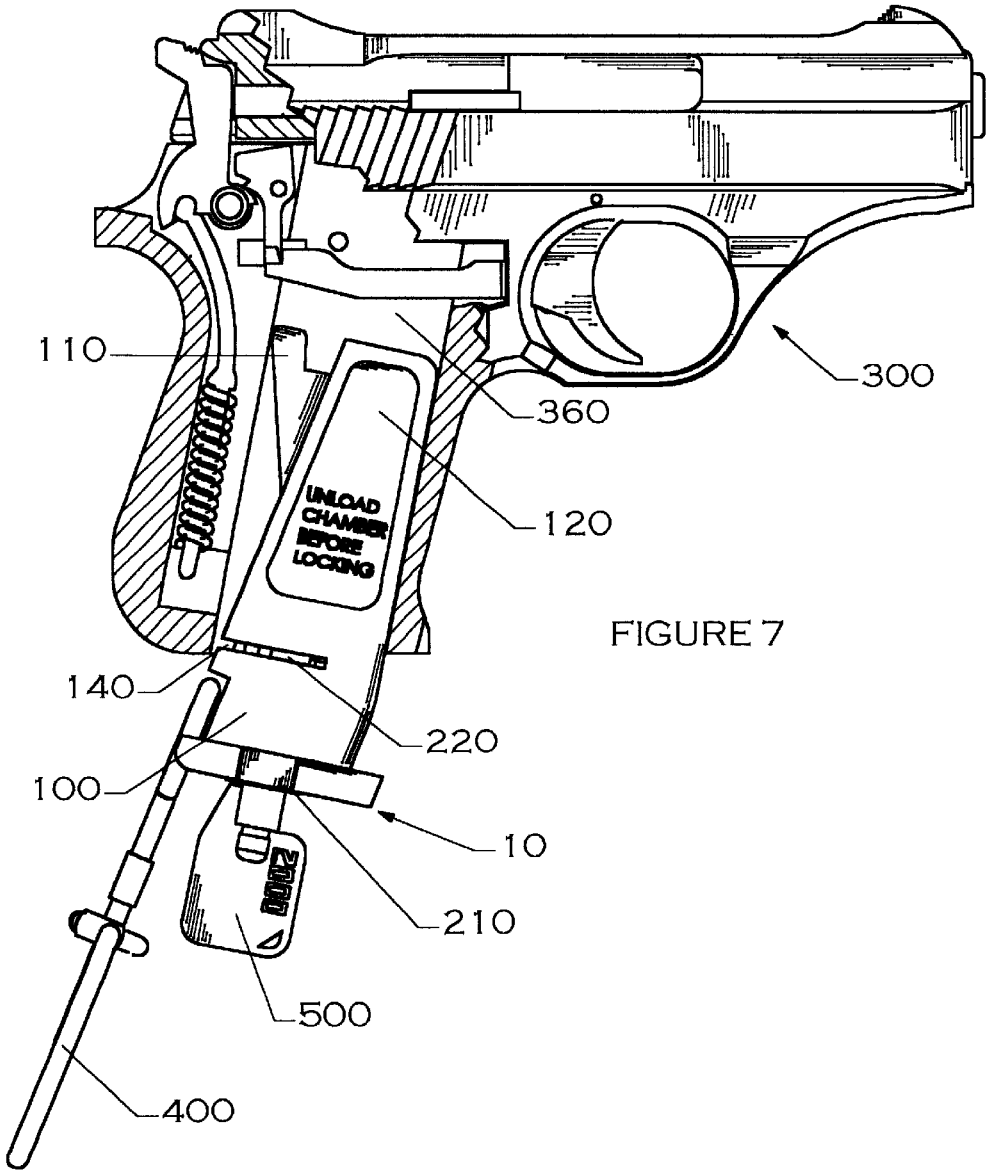
FIG. 7 is a third view in a series of views showing the apparatus of FIG. 1 being positioned within the firearm.
Figure 8:
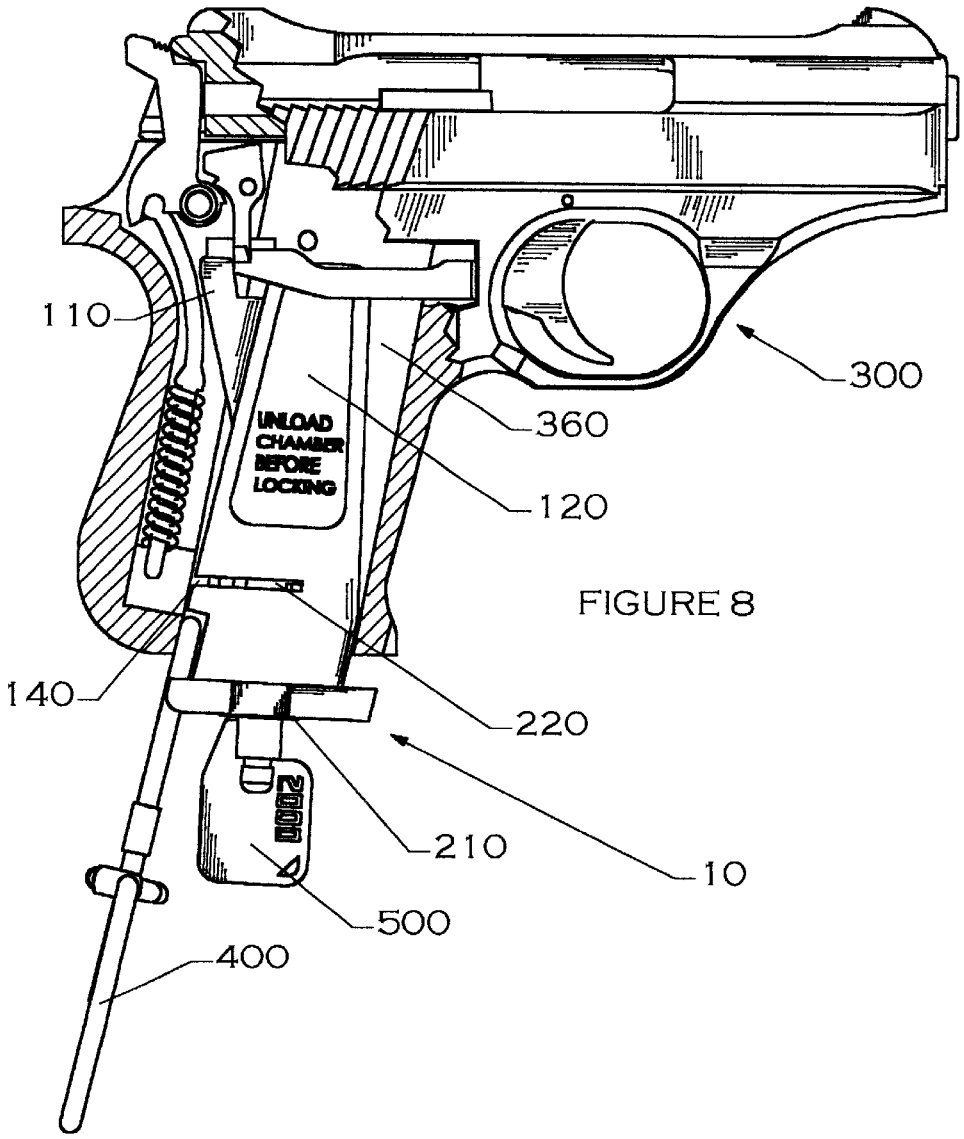
FIG. 8 is a forth view in a series of views showing the apparatus of FIG. 1 being positioned within the firearm.

Body 100 preferably includes retaining mechanism cavity 130 and slot 140 to facilitate the installation and proper functioning of retaining mechanism 200. Cavity 130 is preferably located at an end of body 100 which will be accessible even while body 100 is fully inserted into the magazine well of a firearm. It is also preferred that cavity 130 have an end which is at least partially open to slot 140. Embodiments having a retaining mechanism 200 which differs substantially from the retaining mechanism shown in FIG. 3 may have a different number or differently shaped cavities and slots to accommodate the installation and proper functioning of retaining mechanism 200.

Body 100 preferably includes tether post 150. Inclusion of tether post 150 permits the magazine lock to function as part of a firearm retaining system providing a method for coupling a firearm to an object which is more difficult to transport than the firearm. Such a retaining system would comprise tether 400 in addition to magazine lock 10. A method of using such a system might include the following steps: providing firearm 300; providing tether 400; providing magazine lock 10; coupling tether 400 to an object which is more difficult to transport than firearm 300; coupling tether 400 to magazine lock 10 by looping tether 400 around tether post 150; coupling firearm 300 to tether 400 by inserting magazine lock 10 into the magazine well 360 of firearm 300; locking magazine lock 10 into well 360 to prevent the firearm 300 from being uncoupled from the tether 400. Tether post 150 need not be included in all embodiments of the claimed magazine lock.

Body 100 preferably includes key storage cavity 160. Providing body 100 with key storage cavity 160 is thought to facilitate the secure storage of a key for magazine lock 10/locking mechanism 210 within the magazine well of firearm 300. Key storage cavity 160 need not be included in all embodiments of the claimed magazine lock. For embodiments which do have key storage cavity 160, it is preferred that the cavity 160 be positioned on the body 100 to take advantage of any features of the magazine well which will help prevent removal of a key from the cavity while the body 100 is inserted into the well 360. Thus, for a firearm in which one side of the magazine well is a solid portion of the frame 350 of the firearm, the cavity 160 might be positioned such that frame 350 prevents access to the cavity 160 and the key it contains even when the grip 360 of the firearm is disassembled. Storage cavity 160 may be modified as to size and dimensions and location to allow a key sized and dimensioned differently from that of key 500 to be used.

Inclusion of storage cavity 160 renders magazine lock 10 particularly suitable for use in a method for safely transporting firearm 300, magazine lock 10, and key 500 as a single unit. Such a method might include the steps of placing a first key 500 for lock mechanism 210 in key storage cavity 150; inserting device 10, along with key 500, into the magazine well of a firearm to be transported; utilizing a second key to lock device 10 within the magazine well; transporting the firearm; utilizing the second or a third key to unlock device 10; and removing device 10 from the magazine well to allow access to key 500 and use of firearm 300. Using such a method, a manufacturer could ship a firearm, key, and magazine lock as a single unit to a wholesaler or dealer with the key locked into the magazine well of the firearm via the magazine lock. The wholesaler or dealer would be provided a master key to the magazine lock so as to be able to unlock the magazine lock upon arrival or some later time. A manufacturer might even choose to ship a locked firearm to a purchaser so as to require the purchaser to bring the firearm to a dealer for unlocking, and possible verification of the purchasers eligibility for possession of the firearm such as age.

The locking body retaining mechanism 200 preferably comprises locking mechanism 210 positioned in retaining mechanism cavity 130, and retaining member 220 in slot 140. It is contemplated that alternative embodiments of retaining mechanism 200 other than those shown in the pictures and or described herein may be used so long as the retaining mechanism provides the ability to lock body 100 into the magazine well of firearm 300. As previously discussed, the use of alternative embodiments of retaining mechanism 200 may necessitate corresponding modifications to body 100.

Locking mechanism 210 is preferably a cam lock obtainable from many lock manufacturers with multiple unique key combinations. Locking mechanism 210 may be pinned or crimped into retaining mechanism cavity 130 in such a way as to prevent removal or tampering at any time, or when the magazine lock is inserted into the magazine well of a firearm. It is also preferred that locking mechanism be capable of being master keyed. Locking mechanisms using any reasonable key type are contemplated, such types including but not limited to standard flat and tubular keys. Another feature which is desirable is that the locking mechanism only allow a key to be inserted or removed while the locking mechanism is locked. It is thought that having such a "locked only" feature would provide additional security by making it clear whether the locking mechanism is locked or not. Alternative embodiments of locking mechanism 210 are contemplated, and any reasonable locking mechanism may be used so long as it operates in conjunction with retaining member 220 to allow body 100 to be locked into the magazine well of a firearm.

Retaining member 220 is preferably a steel stamping that attaches to a post of the locking mechanism. Rotation of locking mechanism 210 results in rotation of retaining member 220 such that retaining member 220 rotates around an axis defined by locking mechanism 210 to protrude out of slot 140 of body 100 to engage a portion of firearm 300, preferably the frame 350. While engaging a portion of the firearm, retaining member 220 prevents removal of magazine lock 10 from the firearm. As with key cavity 160, it is preferred that the positioning of retaining member 220, and corresponding slot 140, be done so as to take advantage of any features of the magazine well which may make it more difficult to bypass or improperly manipulate retaining member 220. Body 100 shields a majority of retaining mechanism 200 so placement of retaining member 220 so that it engages a portion of frame 350 which is inaccessible unless the frame 350 is cut or penetrated or magazine lock 10 is removed will make it difficult to remove magazine lock 10 even if firearm 300 is disassembled.

Although retaining member 220 may be bolted or otherwise fastened to locking mechanism 210, it is preferred that retaining member 220 simply be trapped between the locking mechanism 210 and the body 100. Alternative embodiments of retaining member 220 may have a different composition or be sized and dimensioned differently than the embodiment pictured in the figures, so long as the retaining member functions to keep the body 100 from being removed from the magazine well of a firearm while locking mechanism 210 is in a locked configuration.

Firearm 300 may be any firearm having a magazine well. If the functionality provided by safety post 110 is to be utilized, firearm 300 should have a hammer, trigger or other mechanism which can be blocked by safety post 110 so as to prevent the firearm from being discharged.

Tether 400 is preferred to be a steel cable with a loop at each end, although other embodiments may utilize alternative materials, and may or may not be flexible. The overall length of the tether and the size of the loops can vary, but at least one loop should be too small to allow firearm 300 to pass through the loop. Tether 400 can be used in conjunction with magazine lock 10 to couple the firearm to an object which is fixed, or at least less transportable than the firearm being attached. A cable with a loop at each end allows one to encircle a post or other object with the cable, insert a first end of the cable through the loop of the second end of the cable; attach the loop at the first end of the cable to the tether post 150 and inserting and locking magazine lock 10 into the firearm. It should be noted that the use of magazine lock 10 to lock the firearm to a tether provides functionality which is desirable even if the magazine lock does not prevent the firearm from being discharged in situations where theft of the firearm is a concern but proper operation of the firearm is still desirable. Similarly, use of a magazine lock to fasten a firearm to a tether may be desirable when the firearm is being offered for sale. A firearm could be fastened to a display counter or some other object to prevent removal of the firearm without requiring modification of the firearm and possibly without interfering with the buyers ability to examine the firearm.

Key 500 is contemplated to be any standard key suitable for locking and unlocking locking mechanism 210. In some embodiments, key 500 may be sized and dimensioned to fit within the magazine well of the firearm, possibly within a key storage cavity such as key storage cavity 160 of FIG. 2.

Referring to FIG. 10, lock body 100 of magazine lock 10, when fully inserted into the magazine well of pistol 300, can be locked into the magazine well by rotating locking mechanism 210 so as to rotate retaining member 220 to slidingly engage frame 350. While fully inserted as shown, safety block post 110 is positioned between sear 330, which connects trigger bar 340, and strut 320 so as to prevent hammer 310 from being cocked. As can be seen in FIG. 10, while magazine lock 10 is fully inserted into the magazine well of pistol 300, pistol 300 is locked to/coupled with cable tether 400. Referring to FIG. 11, while fully inserted, magazine lock 10 may contain key 500.

Thus, specific embodiments and applications of a firearm magazine lock have been disclosed. It should be apparent, however, to those skilled in the art that many more modifications besides those already described are possible without departing from the inventive concepts herein. The inventive subject matter, therefore, is not to be restricted except in the spirit of the appended claims.

I claim:

1. A magazine lock for a firearm having a grip, a magazine well, and a hammer, the magazine lock comprising:

a body sized and dimensioned to be removeably positioned within the magazine well of the firearm; and a locking body retaining mechanism at least intermittently inhibiting removal of the body from the magazine well;

the body when positioned within the magazine well of the firearm preventing at least one of the following: cocking the hammer of the firearm; and removal of the firearm from a tether.

2. The magazine lock of claim 1 wherein the body prevents cocking the hammer of the firearm, the body comprising a blocking member which blocks movement of at least one of the hammer, a sear, and a strut, and the body member being substantially fixed in position and orientation relative the rest of the body.

3. The magazine lock of claim 1 wherein the body comprises a key storage cavity sized and dimensioned to contain a key for operating the locking body retaining mechanism while the magazine lock is positioned at least partially within the magazine well of a firearm.

4. The magazine lock of claim 1 wherein the body prevents removal of the firearm from a tether, the body comprising a tether post to which a tether can be removably coupled; the tether being removable only while the magazine lock is not positioned within the magazine well of the firearm.

5. The magazine lock of claim 1 wherein the locking body retaining mechanism comprises a retaining member which, while the magazine lock is positioned at least partially within the magazine well, can be positioned to prevent removal of the magazine lock from the magazine well by extending outward from the body into a cavity formed by a frame of the firearm and the body, the cavity being inaccessible even when the firearm grip is disassembled.

6. The magazine lock of claim 1 wherein the body comprises a safety warning cavity sized and dimensioned to protect any instructions placed within the cavity from damage during insertion and removal of the device.

7. The magazine lock of claim 1 wherein the body comprises:

a blocking member which blocks movement of at least one of the hammer, a sear, and a strut, the body member being substantially fixed in position and orientation relative the rest of the body;

a tether post to which a tether can be removably coupled; the tether being removable only while the magazine lock is not positioned within the magazine well of the firearm; and a key storage cavity sized and dimensioned to contain a key for operating the locking body retaining mechanism while the magazine lock is positioned at least partially within the magazine well of a firearm.

8. The magazine lock of claim 1 wherein the body comprises a single piece of a die cast material at least partially containing the locking body retaining mechanism where the locking body retaining mechanism comprises a lock cylinder rotatable within the body and a retaining member coupled to the cylinder so as to rotate when the lock cylinder is rotated such that a portion of the retaining member can be rotated so as to protrude from the side of the body.

9. The magazine lock of claim 8 wherein the body further comprises a tether post for coupling the body to a tether.

10. A method for discouraging removal of a firearm through the use of the magazine lock of claim 1 wherein the body of the device prevents removal of the firearm from a tether, the method comprising the steps of:

providing a firearm;

providing a tether;

providing the magazine lock of claim 1;

coupling the tether to an object which is more difficult to transport than the firearm;

coupling the tether to the magazine lock of claim 1;

coupling the firearm to the tether by inserting the magazine lock of claim 1 into the magazine well of the firearm; and locking the device of claim 1 into the well to prevent the firearm from being uncoupled from the tether.

11. A method for transporting a firearm using the magazine lock of claim 1 wherein the body of the device prevents removal of a key located inside the magazine well, the method comprising the steps of:

inserting a first key within the magazine well of the firearm;

inserting the magazine lock of claim 1 into the magazine well of the firearm;

transporting the combination of firearm, key, and magazine lock;

utilizing a second key to unlock the device of claim 1 to allow it and the first key to be removed from the magazine well of the firearm.

12. The method of claim 11 wherein the second key is a master key and transporting the combination of firearm, key, and magazine lock involves transporting the combination from a manufacturer to a dealer or wholesaler.

* * * * *